US009351546B2

(12) United States Patent
Nevatia

(10) Patent No.: US 9,351,546 B2
(45) Date of Patent: May 31, 2016

(54) MIRAGE EFFECT JEWELLERY

(71) Applicant: M/s. Sunjewels Pvt. Ltd., Mumbai (IN)

(72) Inventor: Shishir B Nevatia, Mumbai (IN)

( * ) Notice: Subject to any disclaimer, the term of this patent is extended or adjusted under 35 U.S.C. 154(b) by 0 days.

(21) Appl. No.: 14/467,048

(22) Filed: Aug. 25, 2014

(65) Prior Publication Data

US 2016/0021993 A1 Jan. 28, 2016

(30) Foreign Application Priority Data

Jul. 22, 2014 (IN) ..... 2360/MUM/2014

(51) Int. Cl.
*A44C 17/00* (2006.01)
*A44C 17/02* (2006.01)

(52) U.S. Cl.
CPC ..... *A44C 17/02* (2013.01); *A44C 17/00* (2013.01)

(58) Field of Classification Search
CPC ..... A44C 17/02; A44C 17/00
USPC ..... 63/28, 27
See application file for complete search history.

(56) References Cited

U.S. PATENT DOCUMENTS

| | | | | | |
|---|---|---|---|---|---|
| 677,075 | A * | 6/1901 | Fuchs | 63/28 |
| 787,733 | A * | 4/1905 | Dover | 63/28 |
| 1,204,917 | A * | 11/1916 | Whitehouse | 63/28 |
| 1,238,721 | A * | 8/1917 | Birnbaum et al. | 63/28 |
| 1,252,966 | A * | 1/1918 | Suderov | 63/28 |
| 1,308,011 | A * | 6/1919 | Gilsey | 63/26 |
| 1,818,324 | A * | 8/1931 | Hamin | 63/28 |
| 2,419,520 | A * | 4/1947 | Tessler | 63/28 |
| 7,707,722 | B1 * | 5/2010 | Kothari | 29/896.412 |
| 2009/0090132 | A1 * | 4/2009 | Dholakiya | 63/12 |
| 2012/0272681 | A1 * | 11/2012 | Kothari | 63/27 |
| 2014/0102140 | A1 * | 4/2014 | Nhaissi | 63/28 |

* cited by examiner

*Primary Examiner* — Emily Morgan

(57) ABSTRACT

The present invention relates to mirage effect jewellery having a rest frame (10) and a plurality of stones (20). The stones (20) are mounted independent of one another such that dimensional variation is absorbable without impairing robustness and appearance of jewellery. At least the upper portion (39U) of the projections (50) gripping the stones (20) is nearly of the same color as the color tinge of the cardinal stone (21) and peripheral stones (22). The refraction and total internal reflection of light beam (60) falling on the mirage effect jewellery (100) is nearly the same as on a one piece diamond.

8 Claims, 12 Drawing Sheets

Element p2 added at two places.

MIRAGE EFFECT JEWELLERY

FIELD OF INVENTION

The present invention relates to a jewellery and particularly to a jewellery with a precious stone of various sizes arranged to give an illusion of an appreciably real larger stone.

BACKGROUND OF INVENTION

Jewellery with precious stones particularly diamonds is an all time fascination. Diamonds of bigger size command a disproportionately high premium over several small diamonds with comparable weight.

There have been several attempts to create jewellery with smaller diamonds giving the impression of a bold and bigger look diamond.

U.S. Publication No 2012/0180524 A1 (Wein et al) discloses a setting technique for gemstone to give them a single stone look when viewed from the top or side. The larger gemstone and the smaller anchor gemstone are held in place with no metal from the setting visible between the gemstones. The base has a plurality of cavities made with respect to the placement on the gemstone on the base. The plurality of cavities provided in the base support the larger gemstone and the anchor gemstone. Also the cavities of the anchor stone are angled with respect to the larger gemstone. The larger gemstone is primarily held by several gemstones and the concept is mainly for round jewellery. U.S. Pat. No. 6,318,121 (Pachauer) also discloses a similar concept using the known invisible setting technique wherein the gemstones are held in place by adjacent gemstones of comparable sizes with no metal visible between the gemstone. The touch gemstone is positioned slightly below the anchor gemstone and held in place by the anchor gemstone. The touch stone and anchor stone are held in place by the cavities provided in the base of the jewellery. Channel walls are provided to support the anchor gemstone and hold them in place. The stones placed take support of one another. U.S. Pat. No. 7,762,104 B2 (Lin) also discloses diamond jewellery having a plurality of peripheral diamonds to overlap and thereby hold the central diamond. A protrusion is formed between adjacent peripheral diamonds. The outer edge of each peripheral diamond is aligned to the peripheral edge of the noble metal base. In all these patents, the diamonds or stone are arranged in such a way that they partial take support of each other to provide an integrated one diamond look. The weakening of one of the diamonds would lead to loosening up of the entire setup; eventually hampering the one diamond look. Hence displacement of one stone collapses the integrity of the entire jewellery.

U.S. Publication No US 2007/0234758 A1 (Mehta) discloses a method of creating an illusion of larger diamond from smaller diamonds. The four corner diamonds (circular and equal size) are placed at four corners of the square and the centre diamond, which is smaller, is placed in the gap formed by the four diamonds placed at the corners. The centre diamond is placed a level below of the other four diamonds. The rim created by the four corner diamonds supports the central diamond while the corner diamonds are held in place by prongs provided. In this disclosure, the centre diamond does not rely on corner diamonds for support. This concept is specific to five diamond arrangement.

U.S. Pat. No. 6,007,907 (Wolf) discloses an arrangement of precious stone of specific shapes. The stones are arranged in such a way that one edge of the stone mates with the edge of the second stone. The larger stones are placed at the corners while the smaller stones (baguettes) are placed in between both the stone (large). In this disclosure, the aim appears to produce distinct composite arrangement of larger size from stones of relatively smaller sizes.

U.S. Publication No 2011/0219820 (Choi) discloses a ring with a composite Diamond Head setting to create an illusion of a big marquise diamond. The head portion is provided with indentation to hold the diamonds of various shapes through invisible setting. The diamonds in prescribed numbers are arranged in juxtaposition with respect to each other to create an illusion.

U.S. Publication No US 2013/0298604 A1 (Shah) discloses a gemstone assembly and prong assembly. The gemstone assembly is in the shape of diamond onto which the small diamonds are set to give an appearance of a larger diamond. The small diamonds are set close together on the shape of the three dimensional faceted diamond. The gemstone assembly is supported by the prong assembly holding the entire structure together.

It is known to persons skilled in the art that diamonds and precious stones of same sizes in reality do have dimensional variation and thus interdependent fitment cannot be reliable.

Also, in the attempt to expose more and more diamond surface, and therefore avoid base metal in view, the strength of the diamond fitment is compromised.

Our invention addresses and solves these problems.

OBJECTIVE OF THE INVENTION

The objective of the invention to provide a new method and setting technique for precious stones, like diamonds to give an optical illusion or a mirage of an appreciably real larger stone.

The objective of the invention is to provide a method and setting technique for independent mounting of each diamond, thus accepting dimensional variation of the diamonds while mounting in the jewellery.

Another object of the invention is to camouflage the setting elements to match the diamond colour and look.

Another object of the invention is to provide a setting of the gemstone in such a way that the passage of light sparkles the diamonds, thus enhancing the overall appearance and attractability of the jewellery.

Another object of the invention is to provide a jewellery which looks like a big diamond at low cost.

SUMMARY OF INVENTION

The term "mirage effect" is coined and used to disclose this invention wherein a combination of optical and camouflaging steps are incorporated to create impression of jewellery with superficially large diamond while in reality the jewellery uses transparent stones of relatively large and small size, arranged and anchored in a particular fashion and their interaction with light creates the desired optical illusion of a large single stone.

A mirage effect jewellery has a rest frame and a plurality of stones arranged on the rest frame such that there is optical illusion and camouflaging or "mirage effect" of a single diamond. The rest frame is made of a precious metal like gold, silver, platinum et cetra. A plurality of stones includes a cardinal stone with a plurality of peripheral stones placed around a periphery of the cardinal stone. The peripheral stones are positioned with respect to the cardinal stone such that the table of peripheral stones is nearly in the same plane as the plane of the crown of the cardinal stone. In this situation, some part of the peripheral stone is underneath the cardinal stone.

A plurality of depressions and a plurality of projections are provided on a top surface of the rest frame onto which the plurality of stones is mounted. The depression has a conical surface having a through hole. The angle of the cone is same as the angle of the pavilion. The conical surface of the depression supports a stone in the vicinity of upper region of the pavilion of the stone while the lower region of the pavilion of the stone passes clear through the hole.

The depression holding the cardinal stone is a cardinal depression while the depression holding the peripheral stone is a peripheral depression. An arrangement of the cardinal depression and peripheral depression varies and depends on the shape of the rest frame.

The specific orientation of the peripheral stone such that the table of peripheral stones is nearly in the same plane as the plane of the crown of the cardinal stone is achieved due to the peripheral depressions being tilted towards an outer side of the rest frame with respect to the cardinal depression by the commensurate degree of inclination. The peripheral depression contains the peripheral stone giving an appearance as being a portion of a crown of the cardinal stone thus contributing to the illusion of a single stone.

A gap is maintained between a cardinal stone and a peripheral stone and also between two peripheral stones. The gap allows a dimensional variation in the peripheral stones being mounted and also the fitting of the peripheral stone is not dependent on the mounting of the cardinal stone and vice versa. Thus, the gap allows either no touching to slightly touching of the edges of the peripheral stone to the edges of the cardinal stone.

The plurality of projections provided on the top surface of the rest frame has a recess facing the girdle of the stones. The stone is gripped through the girdle by bending the projection towards the girdle such that the recesses of the projections securely hold the stones in the depressions. Such projections are commonly known as prongs and the technique by which the plurality of stones is held or set is called prong setting. The plurality of projections could be present at an edge of the rest frame and around the depressions.

Number of projections and height of projections vary depending on the size and shape of the stones. The height of projections is slightly more than level of the girdle of the stone so as to form recess at level of the girdle of the corresponding stone. It is therefore apparent that the projections are visible along with the stones, causing a break in the illusionary continuity in the looks of the stones. To circumvent this, at least the upper portion of the projection is nearly of the same color as the colour tinge of the cardinal stone and peripheral stones. To achieve this, the plurality of projections are generally layered with rhodium using a known rhodium plating technique, rhodium is an element that is a rare, silvery-white, hard, and chemically inert metal and a member of the platinum group. The desired color of the upper portion could be obtained by any other known method and by using known materials.

Consequent to the specific orientation of the peripheral stone such that the table of peripheral stones is nearly in the same plane as the crown of the cardinal stone, the refraction and total internal reflection of light beam falling on the mirage effect jewellery is nearly the same as on a one piece diamond.

The plurality of projection can be a combination of prong setting and bezel setting. The rest frame and therefore the jewellery can have a round shape or a non-round shape. Further, there can be more than one cardinal stone and each cardinal stone can have a set of peripheral stones around its periphery.

In all variations, the cardinal stone as well as the peripheral stones are mounted and held independent of one another and with a definite gap in-between cardinal stone and peripheral stones as also between different peripheral stones. The cardinal stone is held by prong setting while the peripheral stones are held either by prong settings alone or a combination of bezel setting and prong setting. Consequent to mutually independent fixing method of the stones the jewellery is longer lasting. Since there is a definite gap between all the stones, any size variation within known and practical limits does not adversely impact the robustness of stone fixing or mounting or setting. Also, since some part of the peripheral stone is underneath the cardinal stone, the size variation within known and practical limits does not impair the appearance.

DETAILED DESCRIPTION

Preferred embodiment of our invention of a jewellery (100) with a mirage effect will now be described in detail, with reference to the accompanying drawings. The terms and expressions which have been used here are merely for description but the invention can be worked with several variations and the terms and expressions should not be construed to be limiting the invention in any way.

A mirage is a term generally used for a naturally occurring optical phenomenon in which light rays (60) are bent to produce a displaced image of objects and create illusions. Oxford dictionary describes the word "mirage" as an optical illusion.

The term "mirage effect" is coined and used to disclose this invention wherein a combination of optical and camouflaging steps are incorporated to create impression of jewellery with superficially large diamond while in reality the jewellery uses transparent stones of relatively large and small size, arranged and anchored in a particular fashion and their interaction with light (60) creates the desired optical illusion and camouflage of a large single stone.

Figure 9:
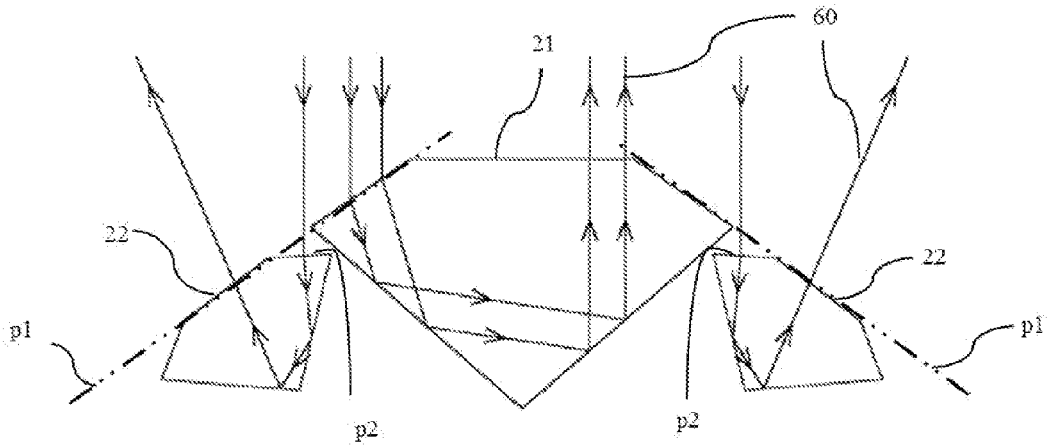
FIG. 9: Illustrate the typical light beam pattern through the plurality of stones with the mirage effect while FIG. 9A Illustrates the light beam pattern on a single large diamond.

The terms crown (25), table (26), girdle (23), pavilion (24) pertain to different parts of a gemstone, as identified in drawings. A plane of the crown (p1), which is a plane between an edge of the girdle (23) and an edge of the table (26), is shown in FIG. 9. The plane of the crown (p1) nearly passes through all the facets of the crown except the table (26). The plane of the crown (p1) is referred to in present invention for a cardinal stone, described below. Peripheral stones, described below, include a plane (p2) between a peripheral stone table and a peripheral stone girdle, as shown in FIG. 9.

Prong (35) and Bezel (36) are commonly known terms used for setting of stones in the jewellery and they are collectively termed as projection (50) in the description. The invention is, however, not limited to these known methods of settings.

Figure 1:
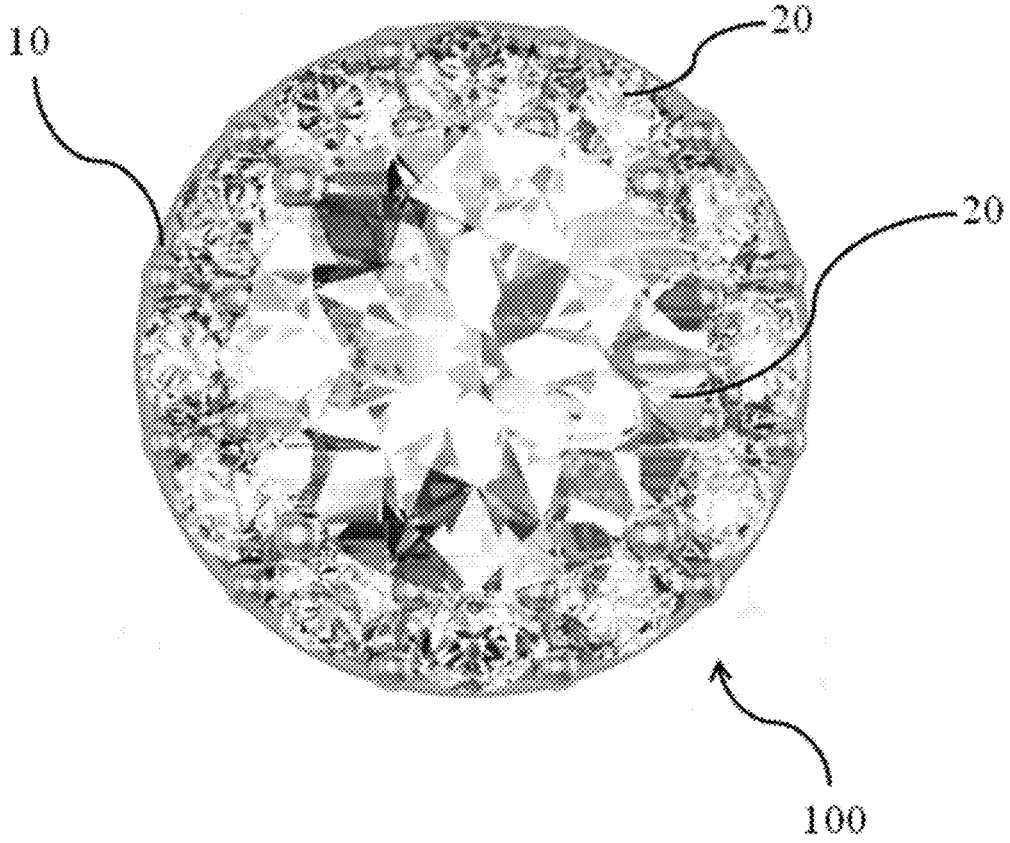
FIG. 1—illustrates mirage effect jewellery as it appears with the precious stone arranged on the rest frame.

FIG. 1, shows an embodiment of a jewellery as it appears. A mirage effect jewellery (100) has a rest frame (10) and a plurality of stones (20), arranged on the rest frame (10) such that there is an optical illusion and camouflaging or "mirage effect" of a single diamond.

The rest frame (10) forms a base onto which the plurality of stones (20) is mounted. The rest frame (10) is made of a precious metal like gold, silver, platinum et cetra. The rest frame (10) can be of various shape and size, referring to FIG. 2 and therefore the jewellery can be of different overall shapes and sizes made using round or non round stones.

Figure 3A:
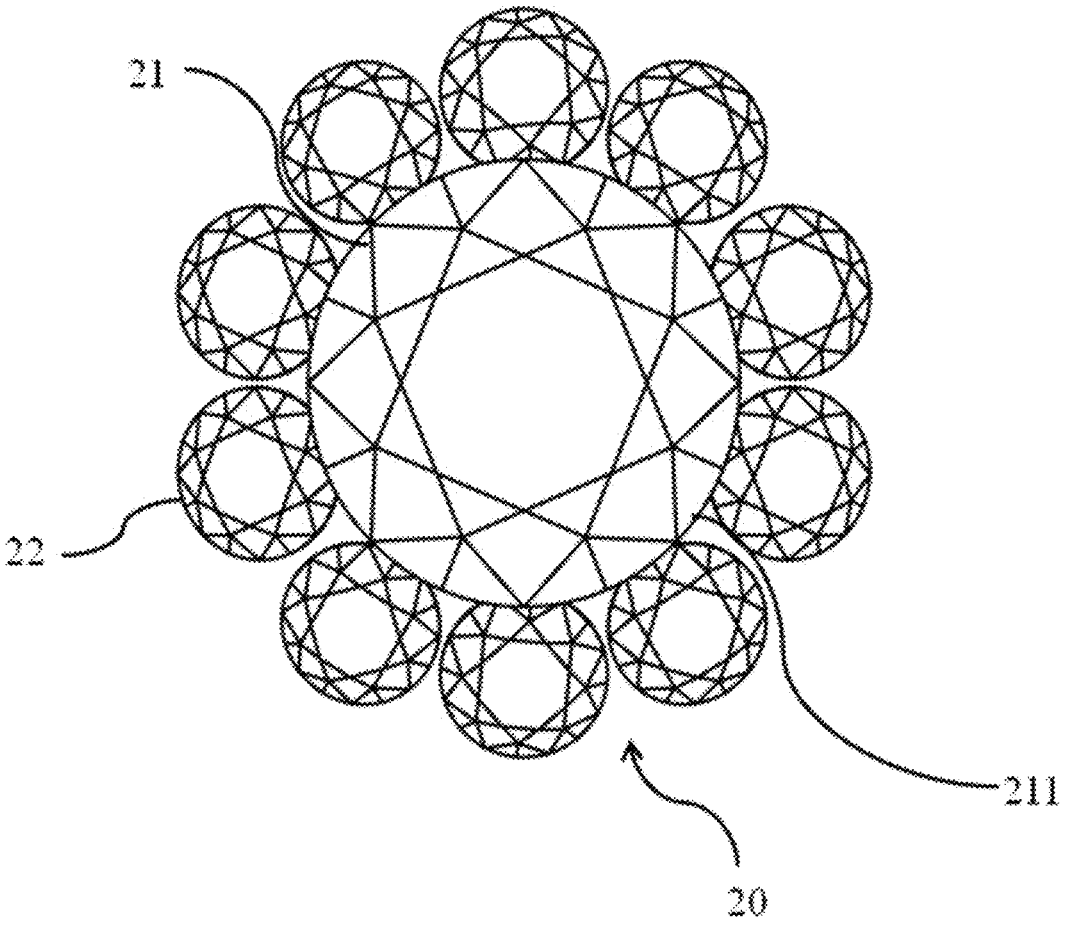
FIG. 3A: Illustrates the plurality of stones includes a cardinal stone and several peripheral stone.
Figure 3B:
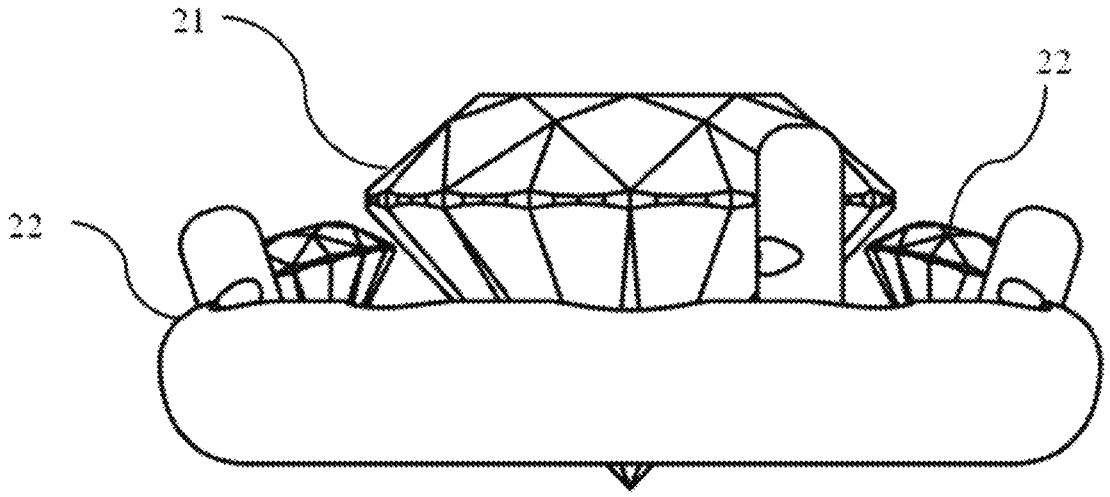
FIG. 3B: Illustrates the peripheral stone being placed below the cardinal stone.

Referring to FIGS. 3A & 3B, a plurality of stones (20) includes a cardinal stone (21) which is relatively a large diamond, with a plurality of peripheral stones (22), which are relatively smaller diamonds, placed around a periphery (211) of the cardinal stone (21). The peripheral stones (22) are positioned with respect to the cardinal stone (21) such that a table (26) of peripheral stones (22) is nearly in a same plane as a plane of the crown (25) of the cardinal stone (21). In this situation, some part of the peripheral stone (22) is disposed underneath the cardinal stone (21), so as to partially obscure the peripheral stone plane (p2), shown in FIG. 9, providing an unseparated view of said cardinal stone girdle and said peripheral stone plane (p2), and providing substantially continuous reflections from said cardinal stone (21) and said plurality of peripheral stones (22).

Figure 4:
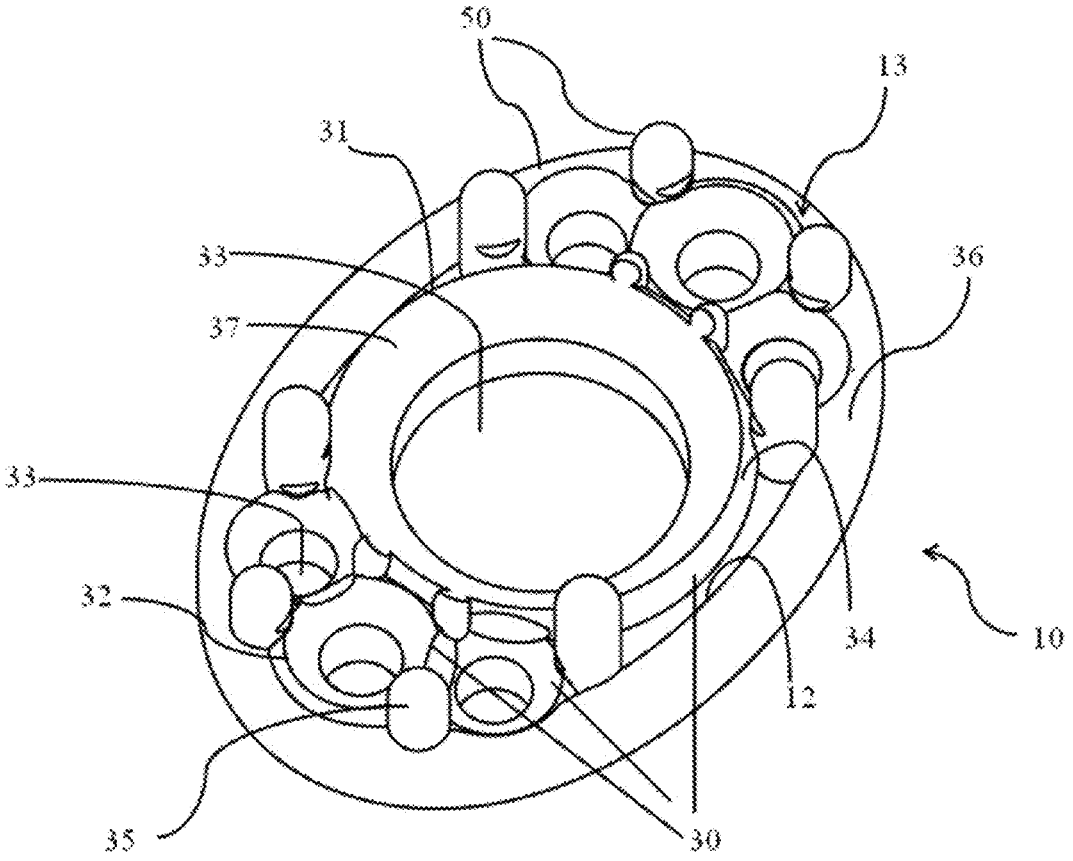
FIG. 4: Illustrates the details of the plurality of depression and the plurality of projections provided on the rest frame.
Figure 5:
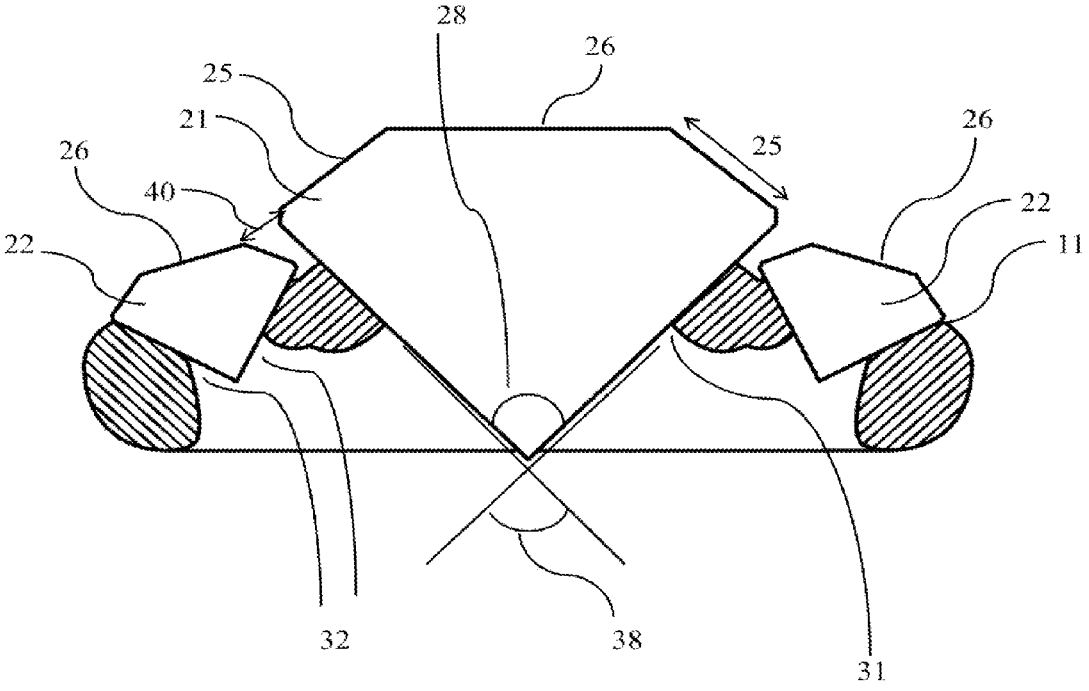
FIG. 5: Illustrates the peripheral depression having a specific orientation.
Figure 6A:
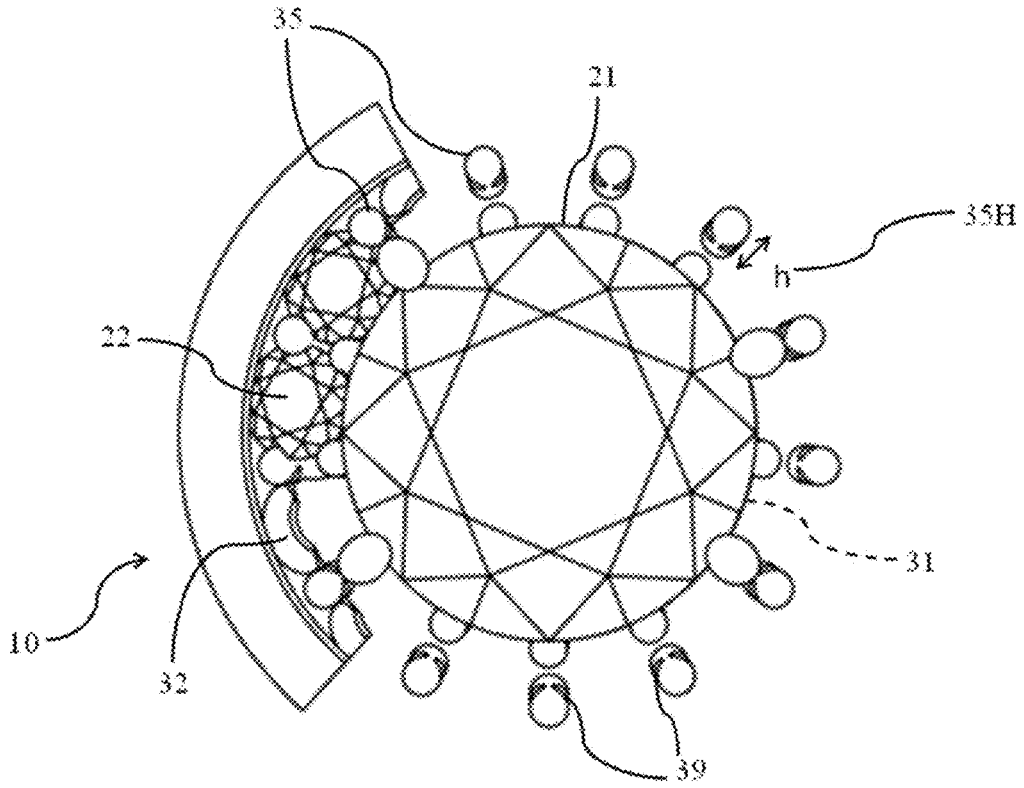
FIG. 6A: Illustrates the plurality of projections holding the plurality of stone i.e. by prong setting.
Figure 6B:
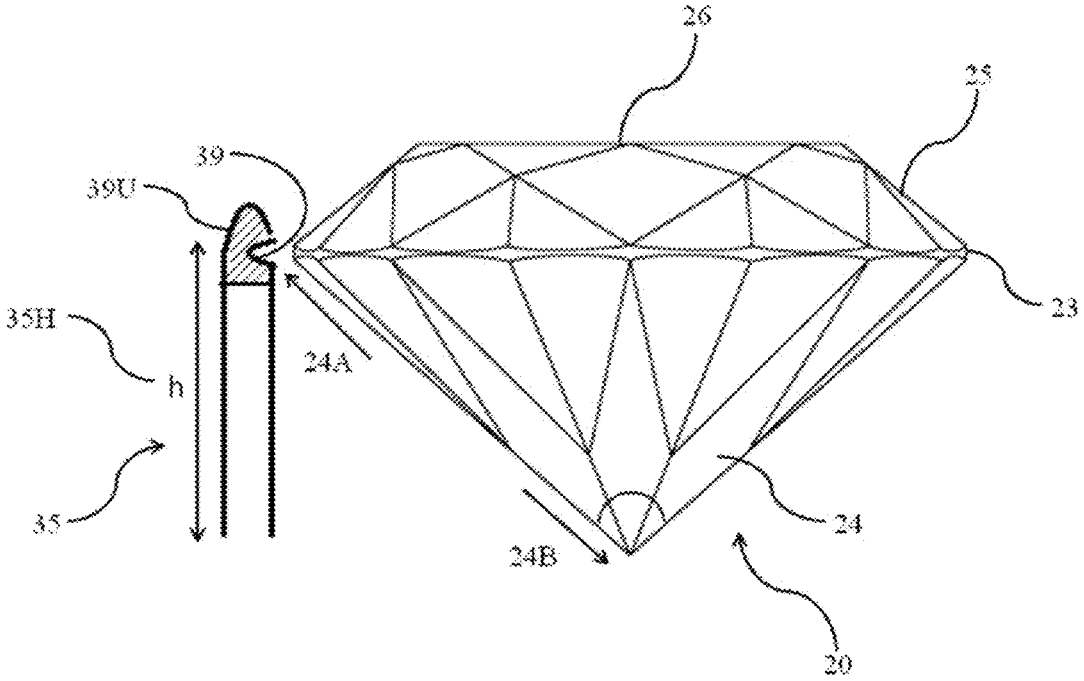
FIG. 6B: Illustrates the stone and the height of the prong.

Referring to FIG. 4, FIG. 5 and FIG. 6B, a plurality of depressions (30) and a plurality of projections (50) are provided on a top surface (13) of the rest frame (10) onto which the plurality of stones (20) are mounted. The plurality of depression (30) has a conical surface (37) having a through hole (33). An angle of the cone (38) is same as an angle of the pavilion (28). The conical surface (37) of the depression (30) supports the stone (20) in the vicinity of an upper region (24A) of pavilion (24) of the stone (20) while a lower region (24B) of pavilion (24) of the stone (20) passes clear through the hole (33).

Figure 2:
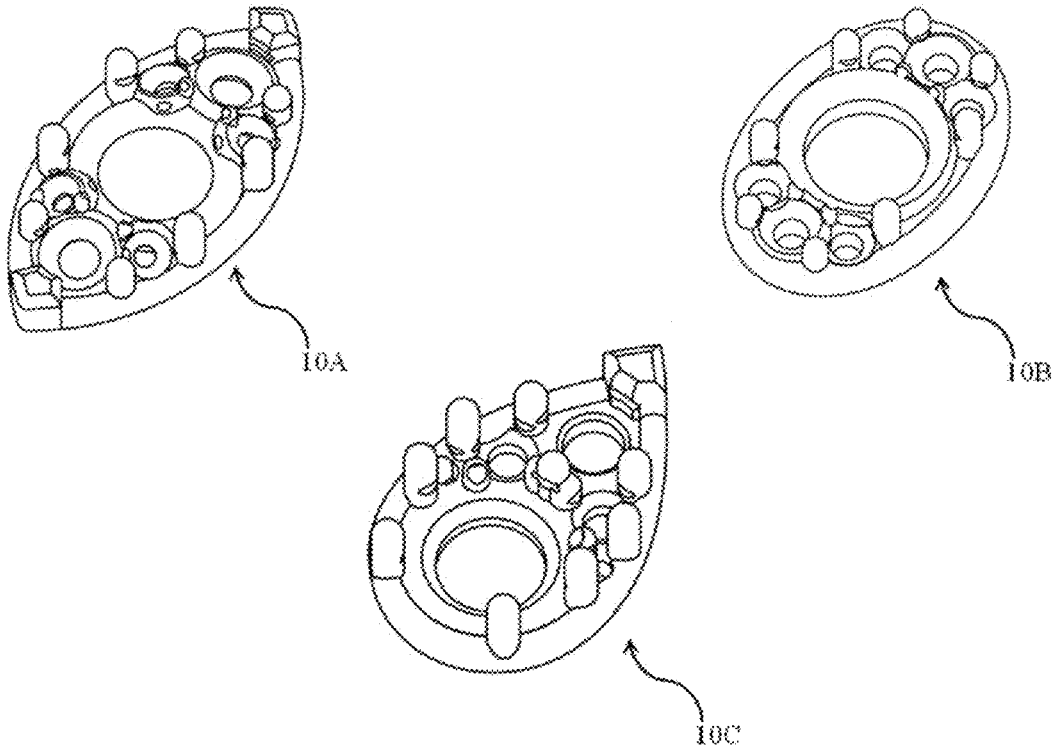
FIG. 2: Illustrates the rest frame having different overall shapes, by which mirage effect jewellery of different shapes can be made using round or non-round stones.

The depression (30) holding the cardinal stone (21) is a cardinal depression (31) while the depression holding the peripheral stone (22) is a peripheral depression (32). An arrangement of the cardinal depression (31) and peripheral depression (32) varies and depends on the shape of the rest frame, as shown in FIG. 2 & FIG. 4.

According to FIG. 5, a specific orientation of the peripheral stone (22) such that the table (26) of peripheral stones (22) is nearly in the same plane as the plane of the crown (25) of the cardinal stone (22), is achieved due to the peripheral depressions (32) being tilted towards an outer side (11) of the rest frame (10) with respect to the cardinal depression (31) by a commensurate degree of inclination. The peripheral depression (32) contains the peripheral stone (22), giving an appearance as being a portion of a crown (25) of the cardinal stone (21), thus contributing to the illusion of a single stone.

A gap (40) is maintained between the cardinal stone (21) and the peripheral stone (22) and also between two peripheral stones (22). The gap (40) allows a dimensional variation in the peripheral stones (22) being mounted and also the fitting of the peripheral stone (22) is not dependent on the mounting of the cardinal stone (21) and vice versa. Thus, the gap (40) allows either no touching to slightly touching of an edge of the peripheral stone (22) to an edge of the cardinal stone (21).

According to FIG. 6A and FIG. 6B, the plurality of projections (50) provided on the top surface (13) of the rest frame (10) have a recess (39) facing a girdle (23) of the stones (20). The stone (20) is gripped through the girdle (23) by bending the prongs (35) towards the girdle (23) such that the recesses (39) of the prong (35) securely hold the plurality of stones (20) in the plurality of depressions (30). The plurality of prongs (35), which is projections (50), could be present at an edge member (12) of the rest frame (10) and around the plurality of depressions (30) as shown in FIG. 4.

Number of prongs (35) and a height, shown as "h" (35H) of prongs (35) vary depending on the size and shape of the plurality of stones (20). The cardinal stone (21) and the peripheral stone (22) are held in the cardinal depression (31) and peripheral depression (32) respectively by multiple prongs (35).

The height, shown as "h" (35H) is slightly more than level of the girdle (23) of the stone (20) so as to form the recess (39) at level of the girdle (23) of the corresponding stone (20). It is therefore apparent that the prongs (35), as the projections (50) are visible along with the stones (20), causing a break in the illusionary continuity in the looks of the stones (20). To circumvent this, at least the upper portion (39U) of the prong (35) is nearly of a same color as a colour tinge of the cardinal stone (21) and the peripheral stones (22). To achieve this, the plurality of projections (50) (which are prongs (35) in this case) are generally layered with rhodium using a known rhodium plating technique, rhodium is an element that is a rare, silvery-white, hard, and chemically inert metal and a member of the platinum group. The desired color of the upper portion could be obtained by any other known method and by using known materials.

Figure 9A:
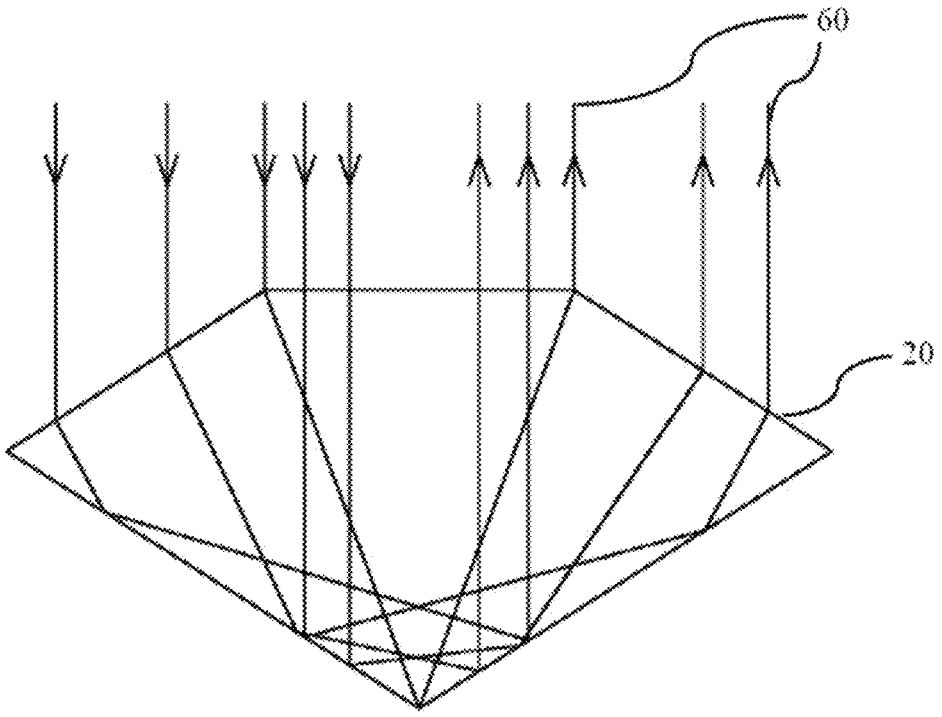

Consequent to the specific orientation of the peripheral stone (22) such that the table (26) of peripheral stones (22) is nearly in the same plane as the crown (25) of the cardinal stone (21), the refraction and total internal reflection of light beam (60) falling on the mirage effect jewellery (100) is nearly the same as on a one piece diamond. FIG. 9 shows a typical light beam (60) pattern on the mirage effect jewellery (100) while FIG. 9A illustrates the light beam (60) pattern on a single large diamond.

Figure 7:
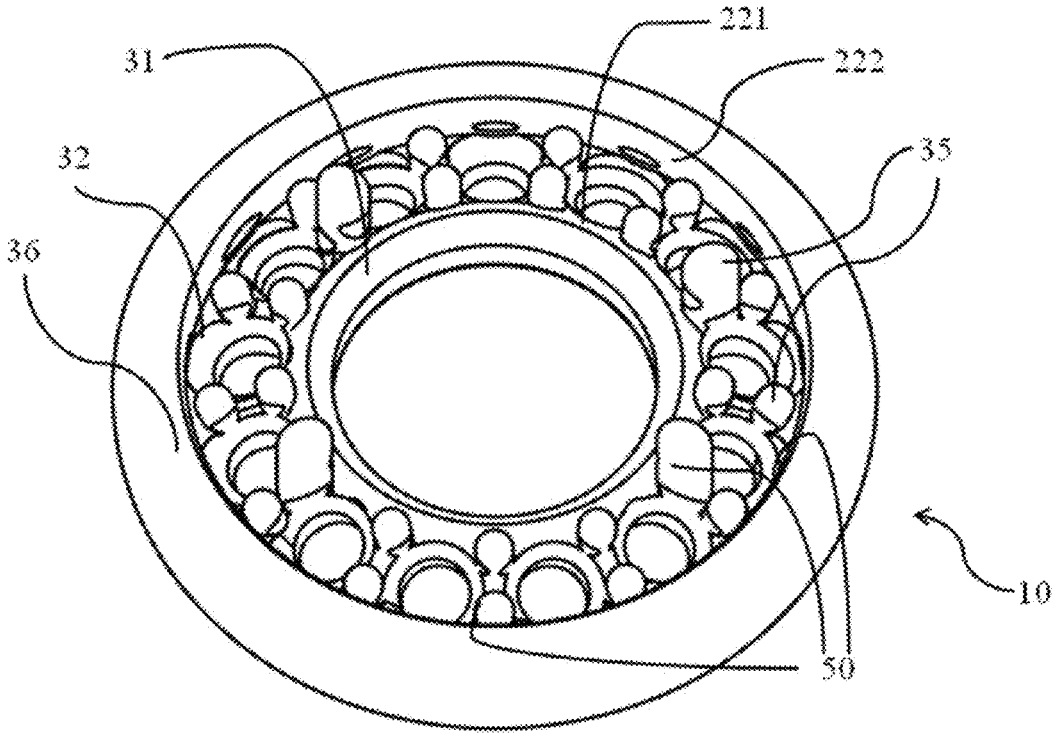
FIG. 7: Illustrates the plurality of projections i.e. bezel and prong.
Figure 8:
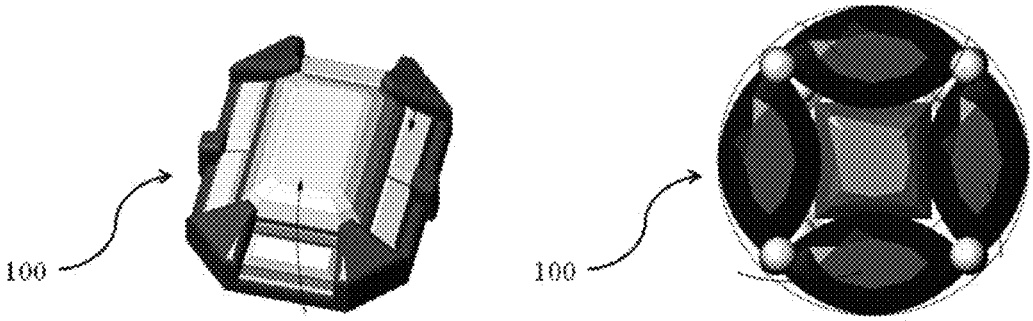
FIG. 8: Illustrates independence between various shape of the diamond and the shape of the rest frame for making mirage effect jewellery.

In another embodiment, referring to FIG. 7, seen with FIG. 4, the plurality of projection (50) includes a prong (35) setting and bezel (36) setting. The peripheral stones (22) are held by a bezel (36) that is a thin wall from the edge member (12) of the rest frame (10) from an outer side (222) of the peripheral stone (22) and a pair of prongs (35) from an inner side (221) of the peripheral stone (22), when placed in the peripheral depression (32). The cardinal stone (21) is held in place by several prongs (35). The bezel (36) and prong (35) supporting the peripheral stones (22) are camouflaged as described earlier.

In another embodiment, referring to FIG. 2, the rest frame (10) has different non-round shapes (10A, 10B, 10C . . . ). Further, there can be more than one cardinal stone (21) and each cardinal stone (21) can have a set of peripheral stones (22) around its periphery (211).

In all variations, the cardinal stone (21) as well as the peripheral stones (22) are mounted and held independent of one another and with a definite gap (40) in-between cardinal stone (21) and peripheral stones (22) as also between different peripheral stones (22). The cardinal stone (21) is held by prong setting while the peripheral stones (22) are held either by prong settings alone or a combination of bezel (36) setting and prong (35) setting. Consequent to mutually independent fixing method of the stones (20) the jewellery is longer lasting. Since there is a definite gap (40) between all the stones (20), any size variation within known and practical limits does not adversely impact the robustness of stone fixing or mounting or setting. Also, since some part of the peripheral stone (22) is underneath the cardinal stone (21), the size variation within known and practical limits does not impair the appearance.

I claim:

1. A mirage effect jewelry creating an illusion of a single large stone, the mirage effect jewelry (100) having a plurality of stones (20) which includes a cardinal stone (21) and a plurality of peripheral stones (22), the cardinal stone (22) having a table (26) and a girdle (23), the cardinal stone (21) having a plane of a crown (p1), the plane of the crown (p1) being a plane between an edge of the girdle (23) and an edge of the table (26), the mirage effect jewelry (100) comprises:

a. the cardinal stone (21) and the plurality of peripheral stones (22) forming a round or a non-round shape arrangement on a rest frame (10);

b. the rest frame (10) including an edge member (12) and including an arrangement of a plurality of depressions (30) includes a cardinal depression (31) and a peripheral depression (32) on the rest frame (10) for holding the cardinal stone (21) and the peripheral stones (22) respectively, each of said cardinal depression (31) and said peripheral depressions (32) include a through hole (33);

c. a plurality of projections (50) along an edge (34) of the plurality of depressions (30) for holding the plurality of stones (20), wherein said plurality of projections (50) include a first set of prongs proximal to said cardinal stone (21) and a second set of prongs spaced from said first set of prongs away from said cardinal stone (21) and disposed to retain said plurality of peripheral stones (22);

d. the plurality of peripheral stones (22) positioned with respect to the cardinal stone (21) such that a table (26) of the plurality of peripheral stones (22) is nearly parallel to the plane of the crown (p1) of the cardinal stone (21), wherein said edge member (12) engages at least one of said peripheral stones;

e. a specific position of the plurality of peripheral stones (22) is achieved due to the peripheral depressions (32) being tilted towards an outer side (11) of the rest frame (10) with respect to the cardinal depression (31) by a commensurate degree of inclination;

f. the peripheral stones (22) each include a plane (p2) between a peripheral stone table and a peripheral stone girdle, wherein part of the plurality of peripheral stones (22) is disposed underneath the girdle of the cardinal stone (21) so as to partially obscure the peripheral stone plane providing an unseparated view of said cardinal stone girdle and said peripheral stone plane (p2) and substantially continuous reflections from said cardinal stone (21) and said plurality of peripheral stones (22);

g. a gap (40) between the cardinal stone (21) and the plurality of pheripheral stones (22) and also between two peripheral stones (22) allowing an independent mounting of the plurality of stones (20) and accepts a dimensional variation in the plurality of peripheral stones (22) mounted in the peripheral depression (32); and h. at least an upper portion of the projection (50) is nearly of a same colour as a colour tinge of the cardinal stone (21) and the plurality of peripheral stones (22) such that a refraction and total internal light reflection of light beams (60) falling on the mirage effect jewelry (100) is nearly the same as one piece of diamond.

2. The mirage jewellery (100) as claimed in claim 1, wherein said plurality of depressions (30) has a conical surface (37) having the through hole (33), an angle of a cone (38) of the plurality of depressions (30) being same as an angle of a pavilion (28) of the plurality of stones (20).

3. The mirage jewellery (100) as claimed in claim 2, wherein the conical surface (37) of the plurality of depressions (30) supports a vicinity of an upper region (24A) of the pavilion (24) of the plurality stones (20) while a lower region (24B) of the pavilion (24) of the plurality of stones (20) passes clear through the hole (33).

4. The mirage jewellery (100) as claimed in claim 1, wherein said plurality of projections (50) is plurality of prongs (35) holding the plurality of stones (20).

5. The mirage jewellery (100) as claimed in claim 1, wherein said plurality of projections (50) is a plurality of prongs (35) and said edge member (12) comprises a bezel (36) encircling and holding the plurality of peripheral stones (22).

6. The mirage jewellery (100) as claimed in claim 4 or 5, wherein each prong (35) has a height "h" (35H) above a girdle (23) of the corresponding stone (20).

7. The mirage jewellery (100) as claimed in claim 1, wherein said rest frame (10) has a round shape.

8. The mirage jewellery (100) as claimed in claim 1, wherein said rest frame (10) has a non-round shape and said plurality of peripheral stones partially encircle said cardinal stone.

* * * * *